US005923298A

United States Patent [19]

Miyahara et al.

[11] Patent Number: 5,923,298

[45] Date of Patent: Jul. 13, 1999

[54] MULTIBAND RECEPTION ANTENNA FOR TERRESTRIAL DIGITAL AUDIO BROADCAST BANDS

[75] Inventors: Shunji Miyahara, Yokohama; Nicolai Lazarov, Kawasaki, both of Japan

[73] Assignee: Ford Motor Company, Dearborn, Mich.

[21] Appl. No.: 08/841,315

[22] Filed: Apr. 30, 1997

[51] Int. Cl.[6] ..... H01Q 1/32; H01Q 7/00; H01Q 5/00

[52] U.S. Cl. ..... 343/713; 343/744; 343/748

[58] Field of Search ..... 343/713, 744, 343/748, 722, 741, 743, 848, 866; H01Q 11/12, 1/32, 7/00, 5/00

[56] References Cited

U.S. PATENT DOCUMENTS

| | | | |
|---|---|---|---|
| 3,599,214 | 8/1971 | Altmayer . | |
| 3,771,159 | 11/1973 | Kawaguchi et al. . | |
| 3,972,048 | 7/1976 | Davis . | |
| 4,003,056 | 1/1977 | Davis . | |
| 4,145,693 | 3/1979 | Fenwick . | |
| 4,184,164 | 1/1980 | Rod . | |
| 4,331,961 | 5/1982 | Davis . | |
| 4,381,566 | 4/1983 | Kane . | |
| 4,527,164 | 7/1985 | Cestaro et al. . | |
| 4,791,426 | 12/1988 | Lindenmeier et al. . | |
| 5,422,650 | 6/1995 | Hill | 343/713 |
| 5,442,368 | 8/1995 | Harada et al. . | |

FOREIGN PATENT DOCUMENTS

| | | |
|---|---|---|
| 960759 | 1/1975 | Canada . |

*Primary Examiner*—Frank G. Font
*Assistant Examiner*—Layla G. Lauchman
*Attorney, Agent, or Firm*—Mark Mollon

[57] ABSTRACT

The invention combines a loop antenna and a dipole antenna in a conformal antenna on the rear window glass of an automotive vehicle above the defogging heater grid. The loop and dipole are adapted to receive Digital Audio Broadcasting (DAB) signals in both L band and Band-III frequency bands with maximum sensitivity to vertically polarized signals while requiring minimal space on the window glass. Inductive components separate portions of the antenna pattern for signals at predetermined frequencies in order to create the different effective antenna shapes at the different frequency bands.

9 Claims, 2 Drawing Sheets

MULTIBAND RECEPTION ANTENNA FOR TERRESTRIAL DIGITAL AUDIO BROADCAST BANDS

BACKGROUND OF THE INVENTION

The present invention relates in general to a multiband antenna, and more specifically to an on-glass automotive antenna performing as a loop antenna at a first digital audio broadcasting (DAB) frequency band and as a dipole antenna at a second DAB frequency band.

Digital audio broadcasting is a broadcast radio service being introduced in many places throughout the world which provides high quality audio and auxiliary data transmissions. One of the most promising applications of DAB is in mobile receivers installed in automotive vehicles, such as cars and trucks.

Various standard transmission protocols, such as Eureka-147, are being established for DAB. European countries and Canada have already begun transmitting terrestrial DAB signals in Eureka-147 format. However, different frequency bands are being designated for DAB service by different governmental authorities around the world. For example, Canadian DAB currently operates in the L-band (from 1452 to 1492 MHz) while European DAB currently operates in Band-III (from 174 to 240 MHz).

Depending upon the final decisions that may be taken around the world in selecting frequency bands for DAB systems and depending upon where a particular DAB receiver may be used (e.g., as an automotive vehicle moves between areas), it may be necessary or desirable to receive in both the L-band and Band-III. However, the use of separate antennas on a vehicle for each frequency band is undesirable because of cost, appearance, and space limitations.

Vertical monopole whip antennas are known which can provide reception in both L-band and Band-III. Whip antennas, however, are undesirable because they create wind noise, are an unattractive protrusion, and are subject to breakage.

Conformal antennas, carried by a vehicle surface such as a window glass, are preferred for automotive vehicles for improved appearance, durability, and elimination of wind noise. However, no existing conformal antenna design is capable of receiving terrestrial signals in both L-band and Band-III. The difficulty results, in part, from the fact that L-band and Band-III are relatively far apart from each other.

Since terrestrial broadcast signals become vertically polarized, one might consider the approach of forming a vertical quarter-wave monopole antenna on a vehicle window to receive both frequency bands. However, the vertical length for such an antenna receiving Band-III is about 350 mm. Therefore, the vertical antenna conductor would mechanically interfere with window-mounted heater wires for the window defogger which are widely used on rear windows. Placing the antenna on the front window where more space is mechanically available is undesirable because the antenna would impinge in the direct, forward-looking field of vision.

SUMMARY OF THE INVENTION

The present invention has the advantage of providing reception in both L-Band and Band-III using a conformal structure with only one antenna feed for both bands and having a compact size that can be placed on a rear window glass of a vehicle.

These and other advantages are obtained from the present invention which provides a multiband conformal antenna for receiving broadcast signals in Band-III and L-band. The antenna includes a support surface and first and second antenna feedpoints disposed on the support surface. A first dipole conductor is disposed on the support surface and is directly connected with the first feedpoint. A second dipole conductor is disposed on the support surface and is directly connected with the second feedpoint. A conductive loop is affixed to the support surface and is generally rectangular while extending a relatively greater distance horizontally than vertically. A first impedance circuit is coupled to the conductive loop and to the first feedpoint. A second impedance circuit is coupled to the conductive loop and to the second feedpoint. The first and second dipole conductors have a combined length equal to about one-half wavelength of a wave within the L band. Furthermore, the first and second impedance circuits provide a relatively greater impedance at L-band frequencies than at Band-III frequencies so that the antenna is equivalent to a loop antenna at Band-III frequencies and a half-wave dipole antenna at L band frequencies.

DETAILED DESCRIPTION OF PREFERRED EMBODIMENTS

Figure 1:
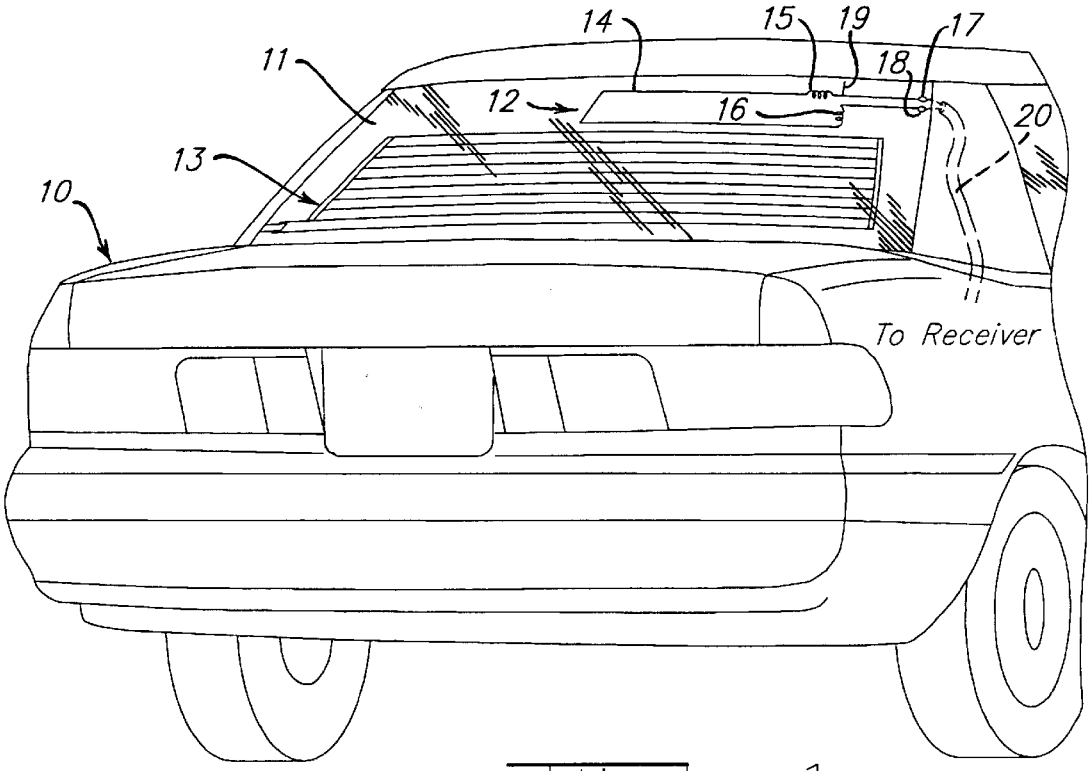
FIG. 1 is a perspective view of an automobile with a heater grid and the antenna of the present invention disposed on its rear window glass.

Referring to FIG. 1, an automotive vehicle 10 has a rear window glass or backlite 11. A multiband antenna 12 is printed on the inside of the rear glass 11. The position of the antenna is at the upper part of rear glass 11 located above a defogger 13. The antenna is shaped as a rectangular loop 14 extending horizontally across rear glass 11 for a relatively greater distance than the vertical height of the loop. Coils 15 and 16 are inserted in the loop between a pair of feedpoints 17 and 18. A conductor 19 for forming part of a dipole extends from loop 14 between coil 15 and feedpoint 17. A second part of the dipole is formed by the conductor between feedpoint 18 and the top of coil 16. Feedpoints 17 and 18 are connected by a cable 20 to a radio receiver (not shown). As described below, the multiband antenna works as a half-wave dipole at Band-III and as a loop antenna at L band with a peripheral length of about one wavelength.

This invention is particularly adapted for a vehicle glass antenna receiving signals of two frequency bands of DAB at Band-III (174 to 240 MHz) and L band (1452 to 1492 MHz) with vertical polarization from terrestrial stations. Prior to this invention, there has not been a conformal antenna for a vehicle capable of receiving these two DAB bands because 1) the frequencies of the bands are far from each other, and 2) if one considers a vertical quarter-wave monopole antenna embedded in a rear glass of a vehicle, the vertical length of the antenna for Band-III is about 350 mm which is too big to fit on the window without interfering with the defogger. The multiband DAB antenna of this invention is realized by using a loop antenna for Band-III while using one portion of the loop as a dipole for L band. Impedance circuits (e.g., coils) work as short circuits in Band-III to thus form the loop for Band-III signals while they work as open circuits in L band to thus isolate the dipole antenna. Since this combined antenna is disposed on the upper part of rear glass 11, there is no mechanical interference between the antenna and defogger lines.

Figure 2:
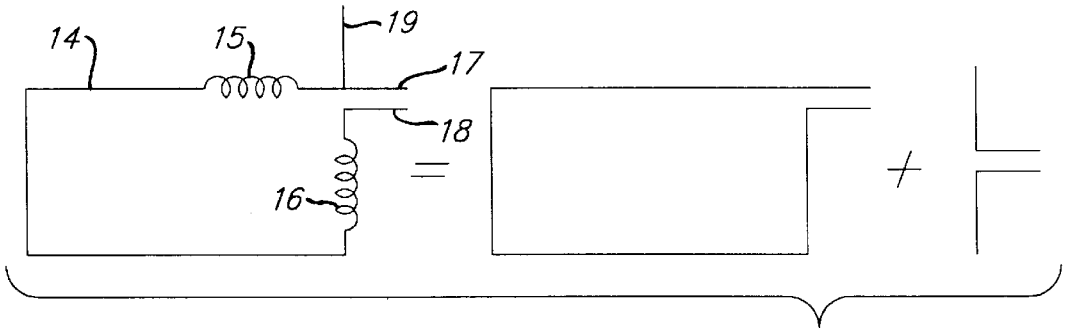
FIG. 2 is a plan view of one embodiment of the invention and equivalent circuits for L band and Band-III signals.

As shown in FIG. 2, the antenna has an equivalent circuit at Band-III which is a loop and an equivalent circuit at L band which is a dipole. The antenna dimensions are selected so that the length of the loop corresponds to about one wavelength in Band-III and the combined lengths of dipole conductor 19 plus the vertical length between feedpoint 18 and the top of coil 16 corresponds to a half-wavelength in L band.

The antenna conductors can be fabricated by printing conductive pastes on the glass surface, by using a metal tape bonded to the glass surface, or by embedding conductive material within layers of the glass. The actual length of various conductors making up the antenna also depends on (e.g. is reduced by) the dielectric constant and thickness of the glass. The vertical height of the antenna is limited depending upon the vehicle on which it is installed.

By way of example, an antenna was constructed having conductor widths of 1 mm. One wavelength in Band-III is about 1300 mm. Based on a wavelength reduction by the glass of about 0.7, the peripheral length of the loop was 910 mm. The length of dipole conductor 19 was 35 mm. The length of the vertical conductor between coil 16 and feedpoint 18 was also 35 mm. Thus, the combined length of the dipole conductors was 70 mm resulting in a dipole antenna of about one-half wavelength in L band (as reduced by the glass reduction factor). The inductance of coils 15 and 16 were chosen to be about 43 nanoHenries.

Figure 3:
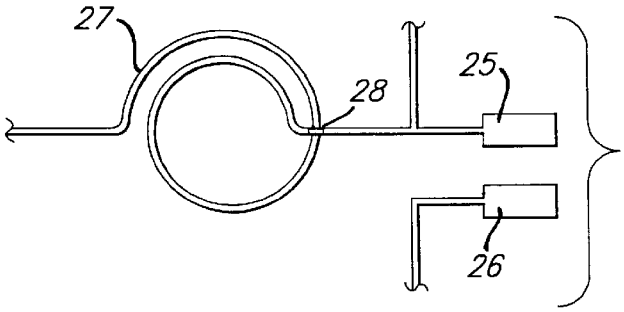
FIG. 3 is a partial plan view of conductive material as deposited on window glass for forming the antenna of the present invention.

A particular construction for the feedpoints and impedance circuit is shown in FIG. 3 wherein a conductive paste is screen printed on the inside surface of a glass window for support. Bonding pads 25 and 26 have an increased size to facilitate soldering of external connections to the antenna. The remaining traces are formed with a width of about 1 mm. A coil 27 is comprised of one and one-half turns. In order to avoid short circuiting of the turns, a bridge 28 is applied providing insulation between the conductors at the intersection.

Figure 4:
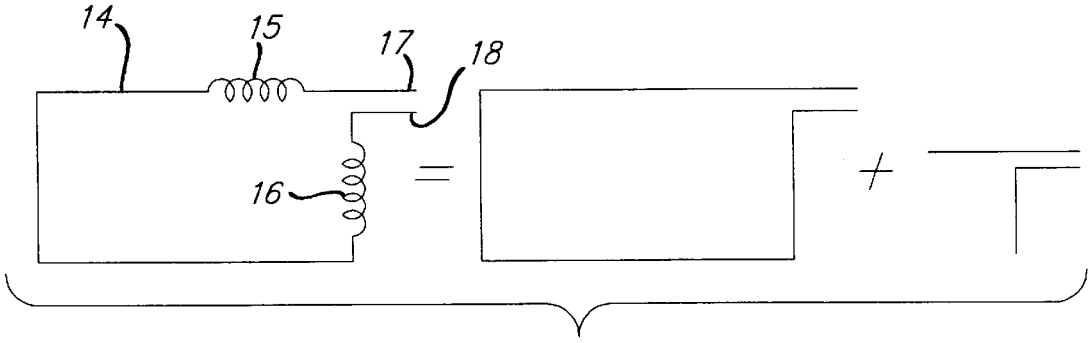
FIG. 4 is a plan view of an alternative embodiment of the invention and equivalent circuits for L band and Band-III signals.

An alternative embodiment is shown in FIG. 4 in which the upper part of the dipole is formed horizontally as part of the loop by moving coil 15 out along loop 14, away from feedpoint 17. The resulting equivalent circuit for the loop antenna is the same as the previous embodiment, but the equivalent dipole antenna has a slightly different shape.

Figure 5:
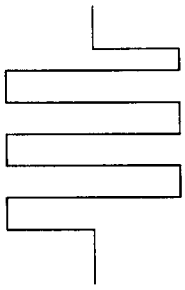
FIG. 5 shows an alternative impedance circuit using a zigzag shape.

The coils forming the impedance circuits in FIGS. 1–4 can be replaced by a zigzag shape inductor as shown as FIG. 5. This shape can be realized in one printed layer without need for a bridge.

Figure 6:
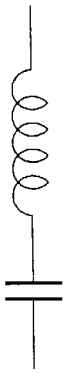
FIG. 6 shows an alternative impedance circuit using a series resonant circuit.
Figure 7:
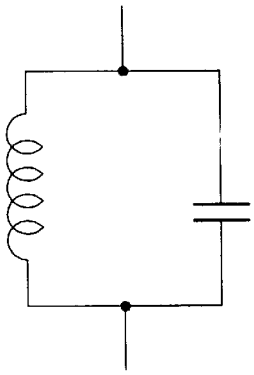
FIG. 7 shows an alternative impedance circuit using a parallel resonant circuit.

The impedance circuits can alternatively be comprised of a series resonant circuit as shown in FIG. 6 or a parallel resonant circuit as shown in FIG. 7. Although more expensive, these resonant circuits can more effectively provide the essentially short circuit needed at Band-III frequencies and the essentially open circuit needed at L band.

What is claimed is:

1. A multiband conformal antenna for receiving broadcast signals in Band-III and L-band, comprising:

a support surface;

first and second antenna feedpoints disposed on said support surface;

a first dipole conductor disposed on said support surface directly connected with said first feedpoint;

a second dipole conductor disposed on said support surface directly connected with said second feedpoint;

a conductive loop affixed to said support surface, said conductive loop being generally rectangular extending a relatively greater distance horizontally than vertically;

a first impedance circuit coupling said conductive loop to said first feedpoint; and a second impedance circuit coupling said conductive loop to said second feedpoint;

wherein said first and second dipole conductors have a combined length equal to about one-half wavelength of a wave within said L band and wherein said first and second impedance circuits provide a relatively greater impedance at L-band frequencies than at Band-III frequencies so that said antenna is equivalent to a loop antenna at Band-III frequencies and a half-wave dipole antenna at L band frequencies.

2. The antenna of claim 1 wherein at least one of said first and second dipole conductors simultaneously forms a portion of a loop for said loop antenna.

3. The antenna of claim 1 wherein at least one of said first and second dipole conductors is comprised of a branch separate from said loop antenna.

4. The antenna of claim 1 wherein at least one of said first and second impedance circuits is comprised of a coil.

5. The antenna of claim 1 wherein at least one of said first and second impedance circuits is comprised of a zigzag coil disposed on said support surface.

6. The antenna of claim 1 wherein at least one of said first and second impedance circuits is comprised of a resonant circuit.

7. The antenna of claim 1 wherein said loop antenna has a loop length equal to about one wavelength of a wave within said Band-III.

8. The antenna of claim 1 wherein said support surface is comprised of a glass panel for a rear window of an automotive vehicle.

9. The antenna of claim 8 wherein said first and second dipole conductors and said conductive loop are comprised of conductive material deposited on said glass panel.

* * * * *